US012110904B2

(12) United States Patent
Bourcier

(10) Patent No.: US 12,110,904 B2
(45) Date of Patent: Oct. 8, 2024

(54) FANS

(71) Applicant: MINETEK INVESTMENTS PTY LTD, Sydney (AU)

(72) Inventor: Remy Marcel Sydney Bourcier, New South Wales (AU)

(73) Assignee: Minetek Investments Pty Ltd, Sydney (AU)

( * ) Notice: Subject to any disclaimer, the term of this patent is extended or adjusted under 35 U.S.C. 154(b) by 0 days.

(21) Appl. No.: 18/133,404

(22) Filed: Apr. 11, 2023

(65) Prior Publication Data

US 2023/0243366 A1 Aug. 3, 2023

Related U.S. Application Data

(63) Continuation of application No. 16/488,569, filed as application No. PCT/AU2018/050146 on Feb. 22, 2018, now Pat. No. 11,649,833.

(30) Foreign Application Priority Data

Feb. 23, 2017 (AU) ..... 2017900608

(51) Int. Cl.
*F04D 29/38* (2006.01)
*F04D 29/52* (2006.01)

(52) U.S. Cl.
CPC ..... *F04D 29/384* (2013.01); *F04D 29/52* (2013.01)

(58) Field of Classification Search
None
See application file for complete search history.

(56) References Cited

U.S. PATENT DOCUMENTS

| | | | |
|---|---|---|---|
| 4,120,609 | A | 10/1978 | Chou et al. |
| 4,152,094 | A | 5/1979 | Honda et al. |
| 4,981,414 | A | 1/1991 | Sheets |
| 5,620,306 | A | 4/1997 | Day |
| 5,769,607 | A | 6/1998 | Neely et al. |
| 6,254,476 | B1 | 7/2001 | Choi |
| 8,337,154 | B2 | 12/2012 | Decker |
| 2004/0165986 | A1 | 8/2004 | Parker et al. |
| 2016/0273547 | A1 | 9/2016 | Gallagher et al. |
| 2018/0100515 | A1 | 4/2018 | Woods |

FOREIGN PATENT DOCUMENTS

GB 2426792 A 12/2006

*Primary Examiner* — Brian O Peters
(74) *Attorney, Agent, or Firm* — Dickinson Wright PLLC

(57) ABSTRACT

In an aspect there is disclosed, a fan arrangement for a duct, the fan arrangement including a housing having an inlet and an outlet adapted to communicate air with the duct and an axially rotatably driven impeller supported within the housing between the inlet and the outlet. The impeller includes a hub carrying a plurality of blades that span in a radial direction outwardly of the hub, the plurality of blades being shaped to urge air between the inlet and the outlet. The plurality of blades may have a tip solidity ratio in the range of about 0.8 to 1.2, and each of the plurality of blades may have a twist angle between a root and a tip thereof in the range of about 15 to 30 degrees and a substantially constant thickness. An impellor, a blade, ventilation system and related methods are also disclosed.

38 Claims, 6 Drawing Sheets

FANS

CROSS-REFERENCE TO RELATED APPLICATION

This application is a continuation of U.S. non-provisional application Ser. No. 16/488,569 filed Aug. 23, 2019, which is a 35 U.S.C. § 371 national stage application of PCT application serial no. PCT/AU2018/050146 filed on Feb. 22, 2018, which claims priority to Australian provisional patent application no. 2017900608 filed Feb. 23, 2017, the entire content of which are incorporated by reference in their entireties.

TECHNICAL FIELD

This invention relates to a fan arrangement, more particularly, the invention relates to an impulse bladed axial fan and an impeller for such a fan.

BACKGROUND

Ducted axial fans are used in a variety of applications including the ventilation of tunnels such as mineshafts and roadways. The need for more air and higher pressures have made the need for existing axial fans to become larger, heavier and noisier, thus occupation health and safety (OH&S) issues are then increased in prominence Such ducted fans include a fan having blades that are rotatable within a housing that fits with the duct. The blades are shaped and have an aerodynamic profile to cause a pressure differential across the blades to draw are through the housing and hence provide pressure to drive air through the duct. The overall length of the duct may in some instances be relatively long and multiple ducted fans may be utilised to maintain the desired pressure and resulting flow rate. In some examples, the ducted axial fans are staged (one-after-the-other) to achieve the required pressure.

A problem with these ducted fans relates to the efficiency of the fans, noise generated, especially for multi-stage fans, and the degradation of performance of the fans due to blade wear in abrasive environments.

The invention disclosed herein seeks to overcome one or more of the above identified problems or at least provide a useful alternative.

SUMMARY

In accordance with a first broad aspect there is provided, a fan arrangement for a duct, the fan arrangement including a housing having an inlet and an outlet adapted to communicate air with the duct and an axially rotatably driven impeller supported within the housing between the inlet and the outlet, the impeller including a hub carrying a plurality of blades that span in a radial direction outwardly of the hub, the plurality of blades being shaped to urge air between the inlet and the outlet.

In an aspect, the plurality of blades has a tip solidity ratio in the range of about 0.8 to 1.2. A tip solidity ratio is measured at or toward tips of the plurality of blades. Each of the plurality of blades may also have a twist angle between respective a hub root and a tip thereof in the range of about 15 to 30 degrees and a substantially constant thickness. The substantially constant thickness may be the profile between a leading edge and a trailing edge and/or substantially constant thickness for the entire blade.

In another aspect, each of the plurality of the blades are formed from a metal plate twisted to provide the twist angle.

In yet another aspect, the hub tapers outwardly in a direction between the inlet and outlet.

In yet another aspect, the housing includes an inner housing supporting the impeller and an outer housing, the inner and outer housing defining a passageway therebetween through which air flows.

In yet another aspect, a post-fan section of the passageway has a cross sectional area that is relatively smaller in comparison to a cross sectional area of a pre-fan section of the passageway.

In yet another aspect, the hub is shaped to provide a tapered transition between the pre-fan and post-fan sections of the passageway.

In yet another aspect, the inner housing includes a nose section, a trailing section with the hub located between the nose section and trailing section, wherein a diameter of the trailing section is greater than a diameter of the nose section.

In yet another aspect, the inner housing includes a tail cone extending from and tapering inwardly from the trailing section.

In yet another aspect, a leading tip of the nose section is shaped to be streamlined.

In yet another aspect, the trailing section includes a flow straightener.

In yet another aspect, the flow straightener is provided in the form of a plurality of turning vanes arranged to provide a substantially axial flow.

In yet another aspect, the nose section includes a flow conditioner shaped to guide air to the blades.

In yet another aspect, the flow condition is provided in the form of at least one of the static and adjustable pre-rotator blades.

In yet another aspect, the outer housing includes an inlet cone arranged prior to the flow conditioner to direct air flow into the passageway and an outlet evasee after the flow straightener, the inlet cone and outlet evasee coupling to the duct.

In yet another aspect, the inner and outer housings are each generally cylindrical in shape and concentrically arranged about an axis of rotation of the hub.

In yet another aspect, the inner housing contains a motor arranged to drive the hub.

In yet another aspect, each of the plurality of blades includes a chord toward the tip that is relatively longer than the chord toward the root.

In yet another aspect, an angle of attack at the root of each of the plurality of blades is less than an angle of attack at the tip of each of the plurality of blades.

In yet another aspect, when viewed in front plan form, leading edges and trailing edges of adjacent ones of the plurality of blades appear to be substantially parallel.

In yet another aspect, at least one of leading and trailing edges of each of the plurality of blades are rounded.

In accordance with a second broad aspect there is provided, a blade for a fan arrangement as described above and herein in any one of the previous claims.

In accordance with a third broad aspect there is provided, an impeller for a fan arrangement as described above and herein.

In accordance with a fourth broad aspect there is provided, a ventilation system including one or more fan arrangements as described above and herein fitted to a duct to drive air between an inlet and outlet of the duct.

In accordance with a fifth broad aspect there is provided, a method of conveying air using a fan arrangement as described above and herein including fitting the fan arrangement with a duct and operating the fan arrangement to drive air between an inlet and outlet of the duct.

In accordance with a sixth broad aspect there is provided, a fan arrangement for a duct, the fan arrangement including a housing having an inlet and an outlet adapted to communicate air with the duct and an axially rotatably driven impeller supported within the housing between the inlet and the outlet, the impeller including a hub carrying a plurality of blades that span in a radial direction outwardly of the hub, the plurality of blades being shaped to urge air between the inlet and the outlet, wherein the plurality of blades have a tip solidity ratio in the range of about 0.8 to 1.2, and wherein each of the plurality of blades has a twist angle between a root and a tip thereof in the range of about 15 to 30 degrees, a substantially constant thickness and a chord length toward the tip is relatively longer than a chord length toward the root.

In accordance with a seventh broad aspect there is provided, a fan arrangement for a duct, the fan arrangement including a housing having an inlet and an outlet adapted to communicate air with the duct and an axially rotatably driven impeller supported within the housing between the inlet and the outlet, the impeller including a hub carrying a plurality of blades that span in a radial direction outwardly of the hub, the plurality of blades being shaped to urge air between the inlet and the outlet, wherein the plurality of blades have a tip solidity ratio in the range of about 0.8 to 1.2, and wherein each of the plurality of blades has a twist angle between a root and a tip thereof in the range of about 15 to 30 degrees, a substantially constant thickness profile and a chord toward the tip that is relatively longer than the chord toward the root.

In accordance with a eighth broad aspect there is provided, an impeller for a ducted fan arrangement having an inlet and an outlet, the impeller including a hub carrying a plurality of blades that span in a radial direction outwardly of the hub, the plurality of blades being shaped to urge air between the inlet and the outlet, wherein the plurality of blades have a tip solidity ratio in the range of about 0.8 to 1.2, and wherein each of the plurality of blades has a twist angle between a root and a tip thereof in the range of about 15 to 30 degrees and a substantially constant thickness.

In an aspect, the hub is shaped so as to compress flow as it passes through the plurality of blades.

In another aspect, the hub is tapered.

In yet another aspect, the each of the plurality of the blades are formed from a metal plate twisted to provide the twist angle.

In yet another aspect, each of the plurality of blades includes a chord toward the tip that is relatively longer than the chord toward the root.

In yet another aspect, an angle of attack at the root of each of the plurality of blades is less than an angle of attack at the tip of each of the plurality of blades.

In yet another aspect, when viewed in front plan form leading edges and trailing edges of adjacent ones of the plurality of blades are substantially parallel.

In yet another aspect, at least one of leading and trailing edges of each of the plurality of blades are rounded.

In accordance with a ninth broad aspect there is provided, a method of forming a fan arrangement for a duct, the method including the steps of: forming a housing having an outer housing and an inner housing so as to form a passageway therebetween, the inner housing supporting a rotatable axially arranged impeller and the housing being shaped such that a pre-impeller section of the passageway is relatively larger in cross section to a post impeller section of the passageway; forming the impeller so as to have a tapered hub between the pre and post impeller sections with the tapered hub carrying a plurality of blades that substantially span in a radial direction between the hub and an internal surface of the outer housing, the plurality of blades being shaped to urge air between an inlet and an outlet of the housing and, forming the plurality of blades so as to have a tip solidity ratio in the range of about 0.8 to 1.2, and so that each of the plurality of blades has a twist angle between a root and a tip thereof in the range of about 15 to 30 degrees and a substantially constant thickness.

In accordance with a tenth broad aspect there is provided, a method of forming an impeller for a ducted fan arrangement having an inlet and an outlet, the method including: forming a hub arranged to taper outwardly in a direction between the inlet and outlet; forming a plurality of blades to fit with the hub from a material having a substantially constant thickness so as to have a twist angle between a root and a tip thereof in the range of about 15 to 30 degrees; forming the impellor by coupling the plurality of blades to the hub such that the plurality of blades span in a radial direction outwardly of the hub to urge air between the inlet and the outlet and have a tip solidity ratio in the range of about 0.8 and 1.2.

BRIEF DESCRIPTION OF THE DRAWINGS

The invention is described, by way of non-limiting example only, by reference to the accompanying figures, in which.

DETAILED DESCRIPTION OF PREFERRED EMBODIMENTS

Figure 1:
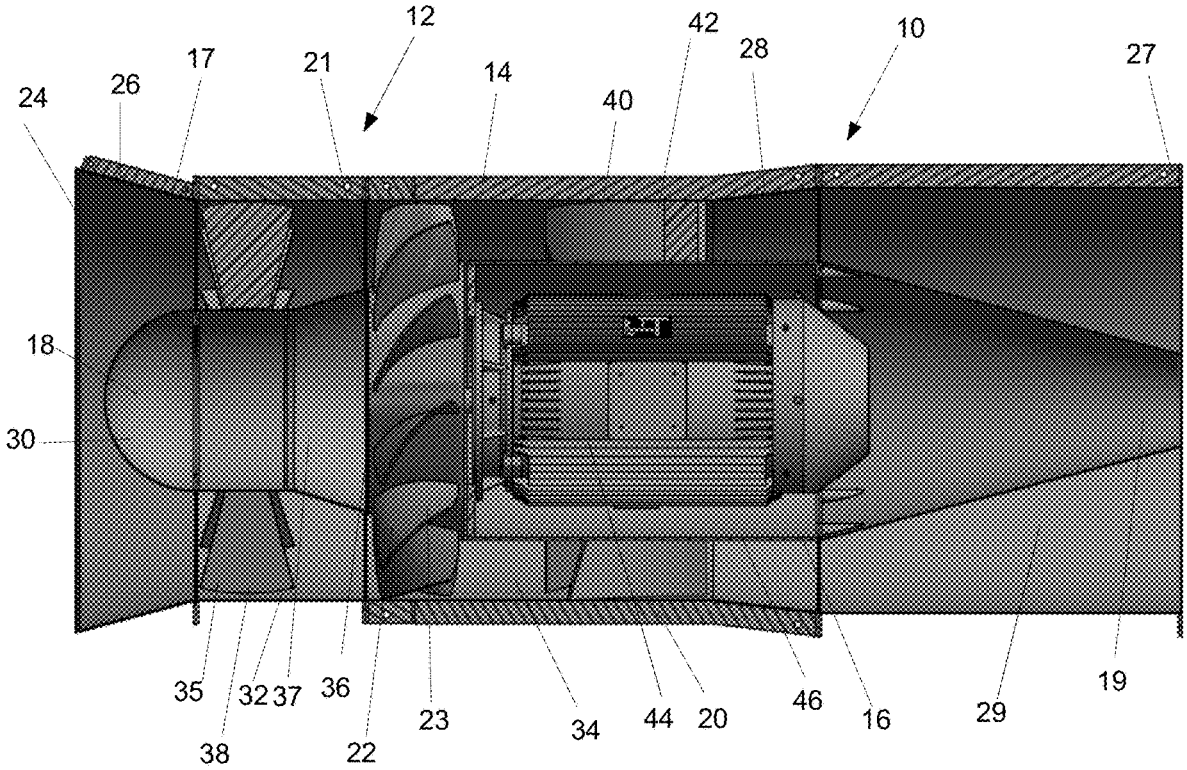
FIG. 1 is a side sectional view illustrating a fan arrangement.
Figure 2:
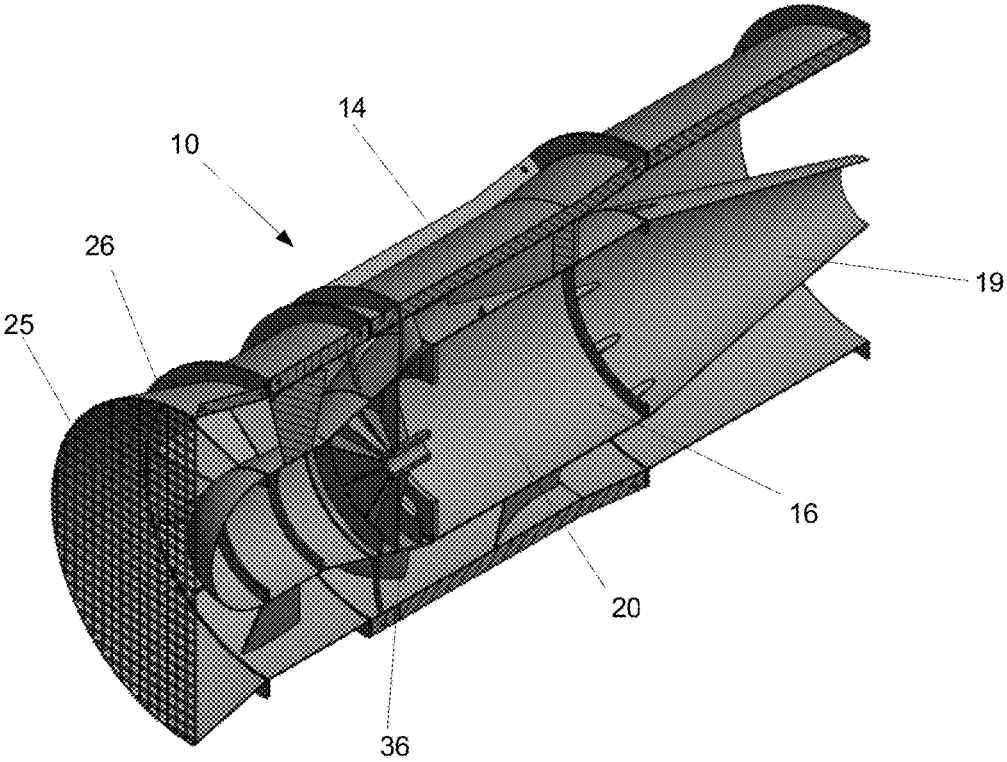
FIG. 2 is a perspective side sectional view illustrating the fan arrangement.
Figure 3:
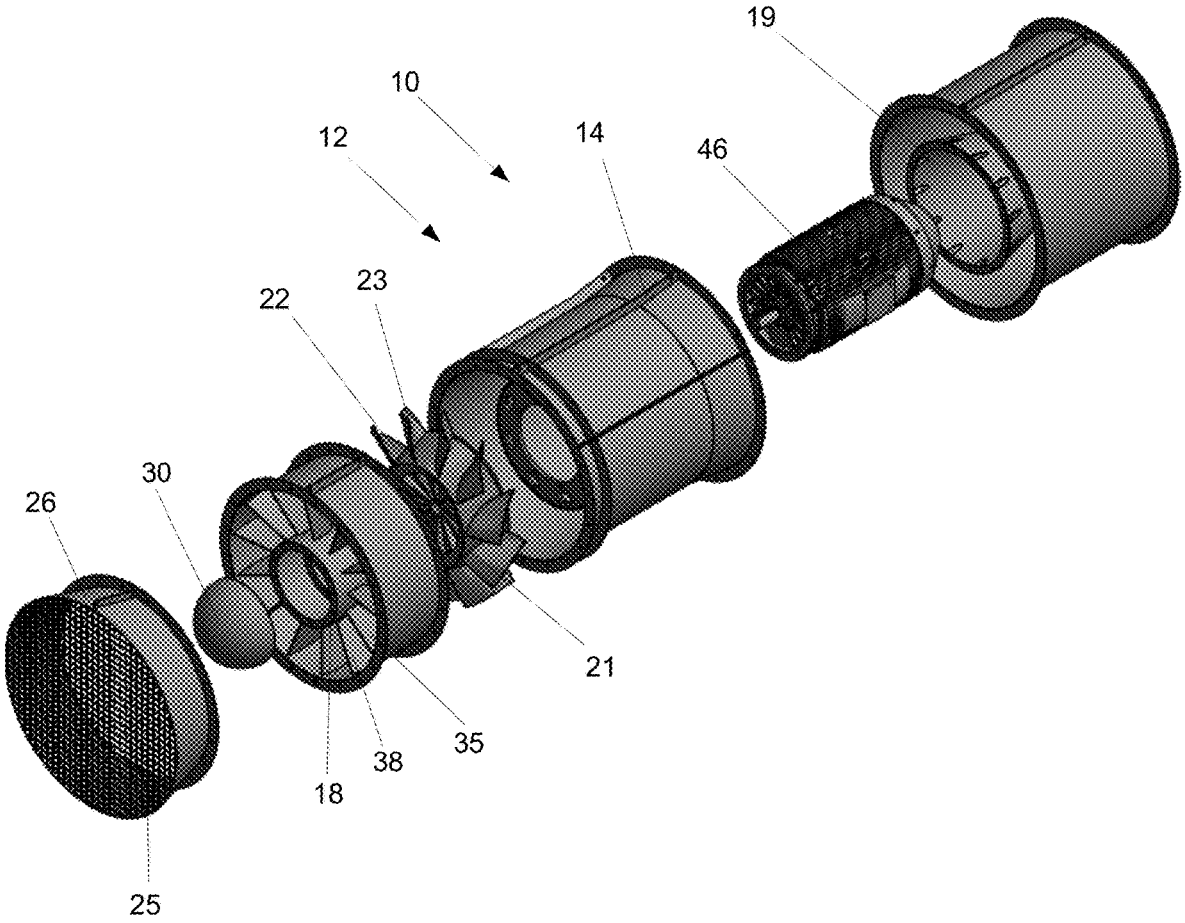
FIG. 3 is a side exploded parts perspective view illustrating the fan arrangement.

Referring to FIGS. 1 to 5, there is shown a fan arrangement 10 for a duct or system of ventilation ducts (not shown) to move or convey air. The fan arrangement 10 includes a housing arrangement 12 having an outer housing 14 and inner housing 16 located within the outer housing 14 so as to define a passageway 17 therebetween. The inner and outer housings 14, 16 may be formed of one or more segments joined with one another.

The inner housing 16 includes a nose section 18, a trailing section 20 and an impeller or fan 22 between the nose section 18 and the trailing section 20. A tail cone 19 is coupled to the trailing section 20 that tapers inwardly toward an axial axis of the housing arrangement 12.

The impeller 22 includes a rotating hub 21 that carries a plurality of likewise rotating blades 23 that extend in a radial direction substantially between the hub 21 and the outer housing 14. The rotating blades 23 each have a substantially flat profile such that the an arrangement 10 may be considered an impulse bladed axial fan in which the impeller 22 drives the airflow by momentum imparted to the air as opposed to a pressure differential as utilised by typical aerofoil ducted axial fans.

The outer housing 14 includes an inlet 24 having an inlet cone 26 adapted to communicate or fluidly couple with the duct and an outlet 27 to re-communicate or fluidly couple with the duct. The inlet cone 26 may be fitted with a grate 25. The outer housing 14 and the inner housing 16 are, at least in part, generally cylindrical in shape and elongate. The outer housing 14 and inner housing 16 are positioned concentrically about the axis of rotation of the impeller 22. The nose section 18 includes a streamlined tip 30 being in this example pointed or domed shaped. The impeller 22 is driven by a motor arrangement 44 having a motor 46 such as, but not limited to an electric motor, adapted to rotate the impeller 22. The motor 46 may be a four pole motor for operation at 50 to 60 Hz, and, as such, in some examples the impeller 22 may be rotated at a fixed speed of about 1500 rpm. In other examples, the motor 46 may have other number of poles and rotate at other suitable speeds. The housing arrangement 12 may be generally formed of a metal such as mild steel.

A pre-fan section 32 of the passageway 17 is defined between the nose section 18 and the outer housing 14. The pre-fan section 32 thereby having a generally annular shaped cross section through which air passes from the inlet 24 to the impeller 22. A post-fan section 34 of the passageway 17 at the trailing section 20 is defined between the inner housing 16 and the outer housing 14. The post-fan section 34 thereby also having a generally annular shaped cross section through which air passes from impeller 22 towards the outlet 27. The pre-fan section 32 has a relatively larger cross sectional area in comparison to the post-fan section 34. The trailing section 20 may include or terminate with an evasee 28 (an outward tapered diffuser section) prior to an expander section 29 as defined between the tail cone 19 and the outer housing 14.

More specifically, in this example, outer housing 14 has a relatively constant diameter along its length. However, the nose section 18 has a relatively narrower or smaller diameter in comparison to the post-fan section 34 thereby the pre-fan section 32 has a relatively larger cross sectional area in comparison to the post-fan section 34. The hub 21 is shaped to transition between the nose section 18 and the trailing section 20. In this example, the hub 21 is generally truncated frusto-conical in shape to provide a generally straight tapered surface 36 in side profile between the nose section 18 and the trailing section 20. The blades 23 extend radially from the tapered surface 36 of the hub 23. The tapered surface 36 of the hub 21 provides compression of the airflow as it passes through the blades 23 into the outlet section 34. The nose section 18 may include a further likewise tapered section 3 7 immediately prior to the tapered surface 36 of the hub 21.

The pre-fan section 32 includes a flow conditioner 35 is provided in the form of at least one of a static and adjustable pre-rotator blades 38 that extend radially from the nose section 18 to the outer housing 14. In examples wherein the pre-rotator blades 38 are adjustable, the pre-rotator blades 38 may be used to control the fan characteristics such as the volumetric flow rate output. When controllable pre-rotator blades 38 are used, the impellor 22 may be operated at a fixed rotation speed and the pre-rotator blades 38 may be used control the volumetric flow rate whilst the impellor 22 is maintained as the fixed speed.

The pre-rotator or pre-fan blades 38 guide air to the impeller arrangement 22. The post-fan section 34 includes one or more flow straighteners 40 provided in the form of turning vanes 42 extending radially from the trailing section 20 to the outer housing 14. One or both of the pre-rotator blades 38 and the turning vanes 42 support and suspend the inner housing 16 within the outer housing 14.

Referring to FIGS. 4*a* to 7, turning now to the impeller 22, in particular the blades 23, each blade includes a twisted blade body 50, a root 52, a tip 54, a leading edge 56 and a trailing edge 58. In this example, each of the blades 23 includes a twist angle between a hub root of the blade and a tip of the blade in the range of about 15 to 30 degrees.

The blade body 50 has a substantially constant thickness across the chord and length. To achieve the constant thickness the blades 23 may be each formed from a metal plate that is twisted to provide the twist angle. The constant thickness plate, being preferably symmetrical in profile and not aerofoil shaped, are resistive to wear and therefore the performance of the fan arrangement may be maintained over time. The constant thickness or flat blades 23 function by increasing velocity imparted to the flow through the impeller 22 without substantially increase of pressure. The constant thickness or flat blades 23 therefore functions differently to an aerofoil shape that relies mainly on a pressure differential to drive the flow. The leading edge 56, trailing edge 58 and tip 54 may be rounded or radiussed to reduce turbulence. The constant thickness or flat blades 23 also inhibit stalling especially when used with prerotator blades 38 that move through relatively large angles such as +40 degrees to −40 degrees.

Figure 4A:
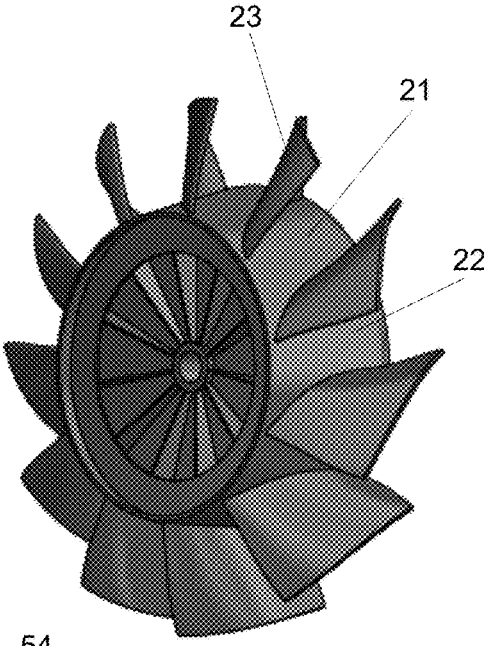
FIG. 4*a* is a front side perspective view illustrating an impeller of the fan arrangement.
Figure 4B:
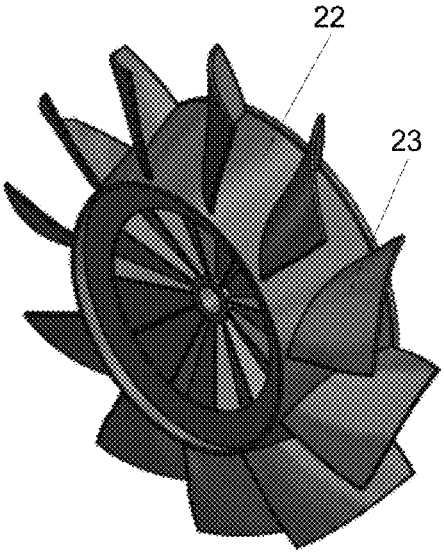
FIG. 4*b* is a topside perspective view illustrating an impeller of the fan arrangement.
Figure 4C:
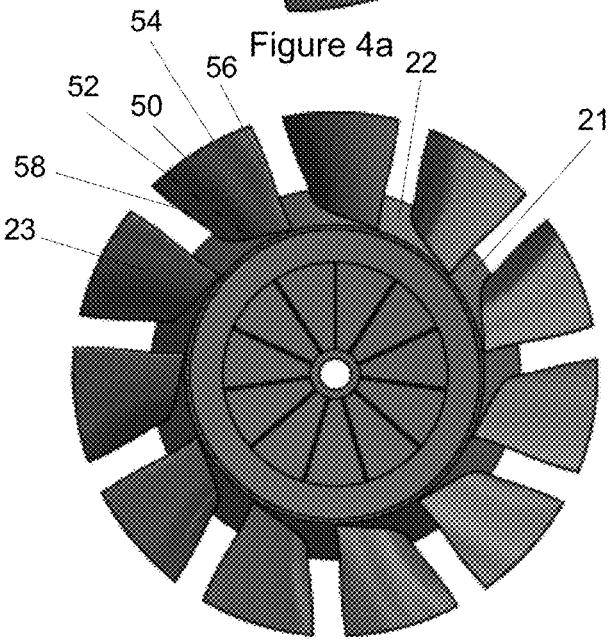
FIG. 4*c* is a front view illustrating the impeller.
Figure 4D:
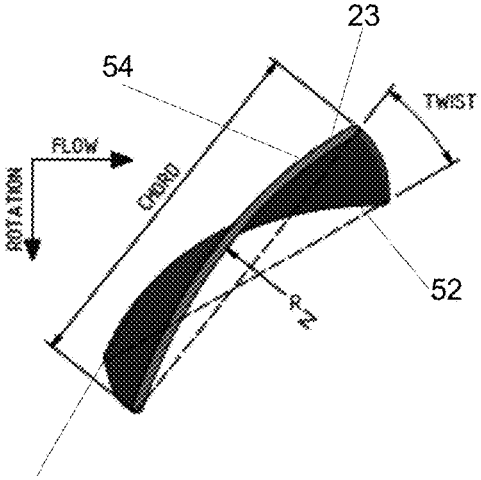
FIG. 4*d* is an end view illustrating a blade of the impeller.

The impeller 22 may be generally formed of a metal such as mild steel. It may be appreciated, in from FIG. 4*c*, that the blades 23 occupy much of the space through which air flows through the impeller 22. In front plan form view, as shown in FIG. 4*c*, it may also be appreciated that the leading edges 56 and the trailing edges 58 of adjacent blades 23 are substantially parallel. The blade twist angle is best shown in FIG. 4*d* and is measured between the blade root 52 and the blade tip 54. The range is about 15 to 30 degrees. However, preferably, the blade twist angle may be about or close to 19 to 23 degrees, and most preferably about 21 degrees.

Figure 6:
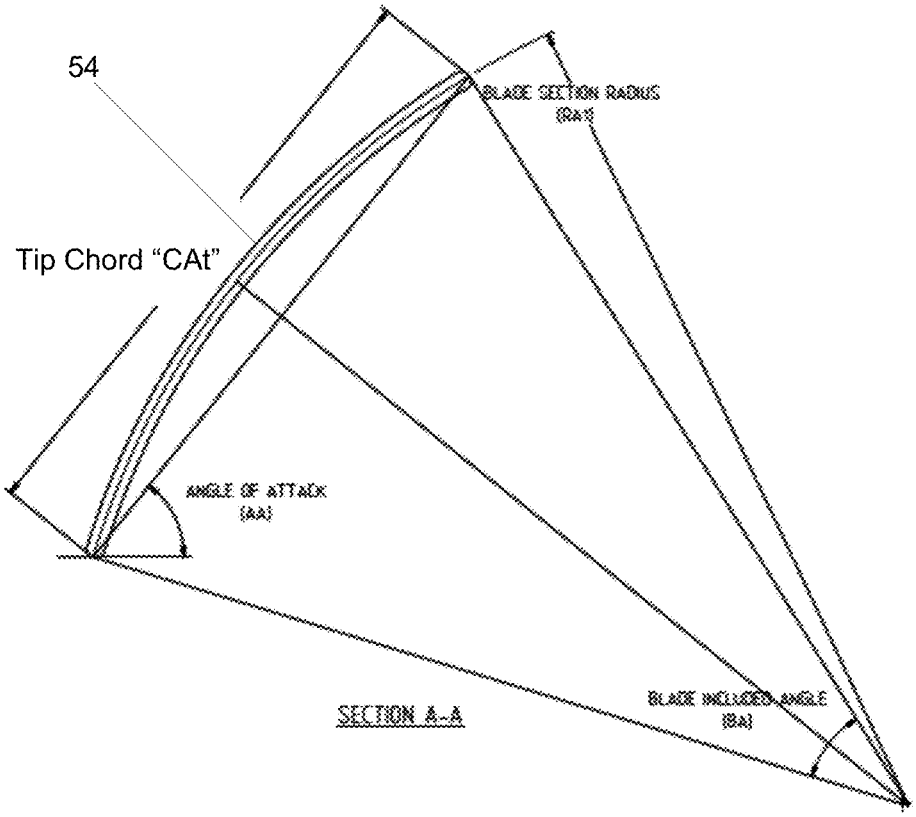
FIG. 6 is an end view illustrating section A-A as indicated in FIG. 5.
Figure 7:
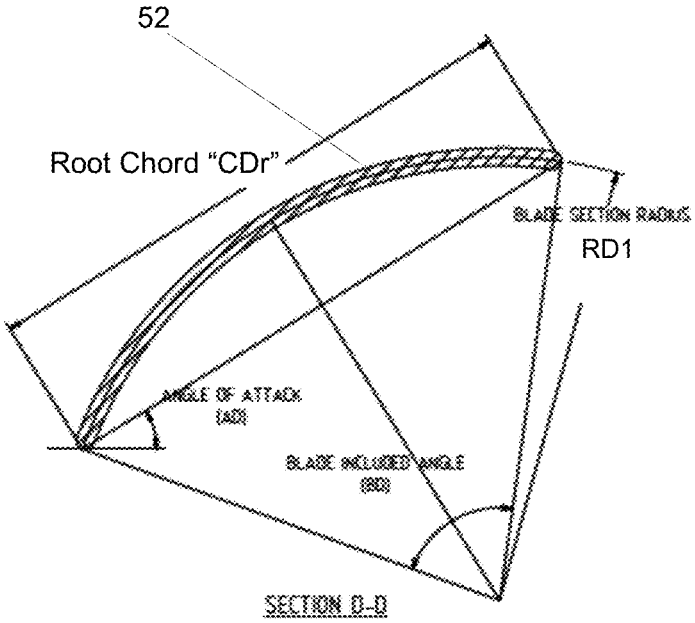
FIG. 7 is an end view illustrating a section D-D as indicated in FIG. 5.

In this example, the chord "CAt" at the tip 54 of the blades 23 is substantially longer relative to the chord "CDr" at the base or root 52 of the blades 23 (best seen by comparing FIGS. 6 and 7). As such, the solidity ratio at the tip "SRt" at Section "A-A" may be in the range of about 0.8 to 1.2, and the solidity ratio "SRr" at Section "D-D" may be in the order of about 1.1 to 1.4. In some embodiments, the solidity ratio "SR" at Section "D" may be in the order of about 1.20 to 1.5. The solidity ratio of Section "A" may be in the range of about 1.25 to 1.55. In another unit of measure, it is noted that the aspect ratio (being a ratio of its span or blade length to its mean chord) of the blades is quite low due to the relatively long chord. The base or root 52 of the blades 23 may be shaped or tapered to match the tapering of the hub 21.

Figure 5:
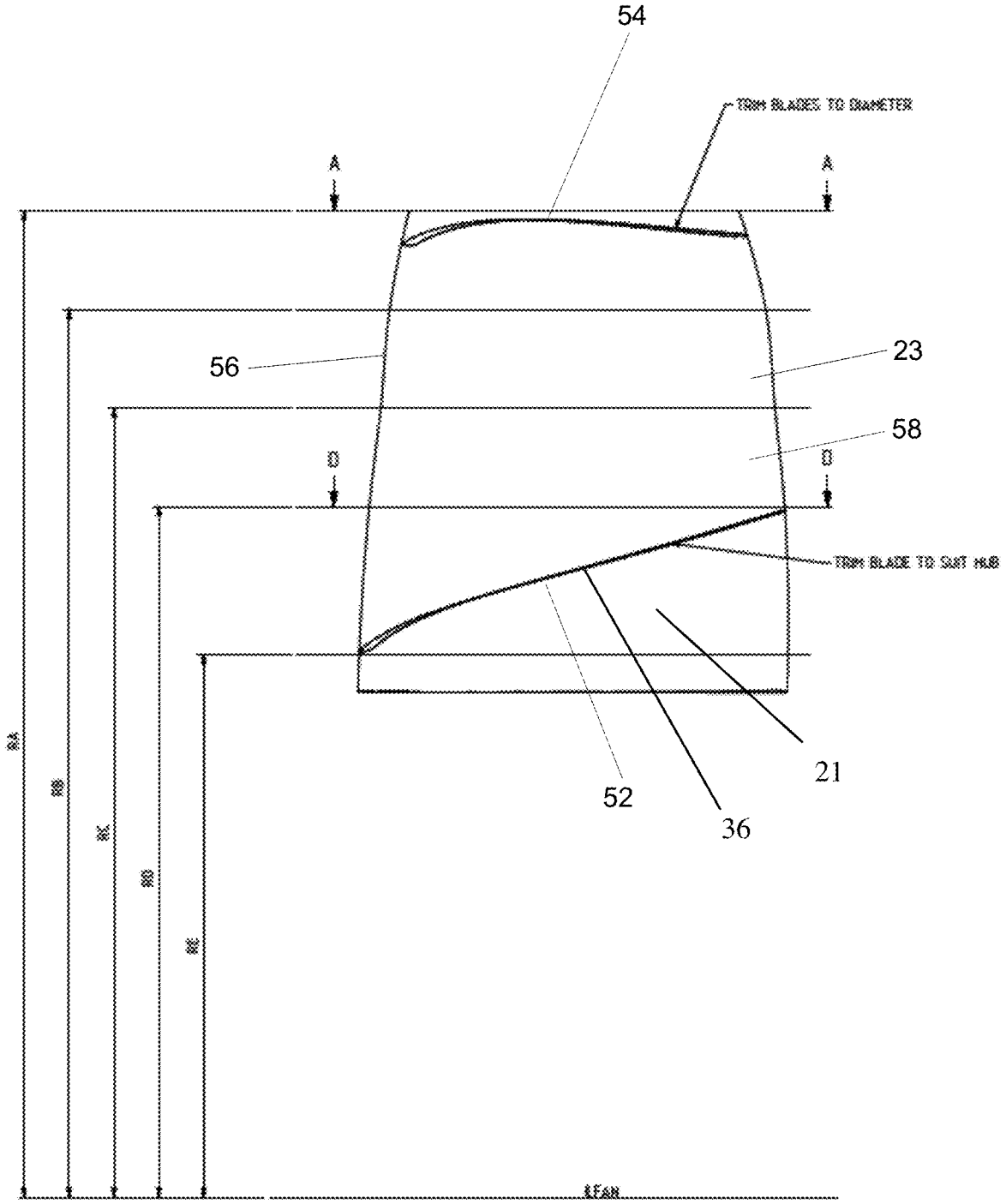
FIG. 5 is a front view illustrating the blade of the impeller showing section A-A toward a tip and section D-D toward a root of the blade.

The blade tip solidity ratio "SRt" is defined herein as the sum of the tip chord lengths "CAt" of all blades 23 at tips 54 thereof (i.e. measurement of the chord at section A-A of the blades 23 as shown in FIG. 5) divided by the perimeter at the diameter "D" of the blades 23. By way of example only, the chord width "CAt" of the blade 23 at the tip 54 may be, for example, 350 mm. There may be 11 blades, so 350 mm×11 gives 3850 mm. The diameter "D" may be, for example, 1320 mm. Accordingly, the perimeter is n×D which gives 4147 mm. The "SRt" Ratio in this example is=3850/4147=0.93. Other variations of the "CAt" and "D" may be used. It is noted that "D" is preferably in the range of about 0.8 m to 2.1 m.

Similarly, the blade root solidity ratio "SRr" is defined herein as the sum of the root chord lengths "CDr" of all blades at hub 21 outside diameter (i.e. measured at the root 52 at section D-D of the blades 23), divided by hub 21 outside perimeter "Hp" (in this example the perimeter is measured at the larger diameter of the tapered hub 21 at 0.7*D where "D" is the diameter the blades 23).

In this example, the hub 21 has a relatively large diameter and circumference that results in the solidity ratio being relatively low in comparison, for example, to typical ducted axial fan. The tapered shape of the hub 21 may vary from about, but not limited to, 0.55×D to 0.7×D.

Still referring to FIGS. 6 and 7, it may be appreciated that the angle of attack "AD" of the blade 23 at the root 52 is less than the angle of attack "AA" at the tip 54. In this example, the angle of twist between sections A-A & D-D is between 19 to 23 degrees, the applicable fan diameter "D" sizing may be between about 800 mm & 2000 mm tip diameters, and the blade section radius is between 200 to 500 mm. However, as aforesaid, suitable twist angles may be in the range of about 15 to 30 degrees. It is noted that the sections A-A & D-D are generally "arc" shaped due to the applied twist and the profile of the blades 23 is substantially constant. The "arc" at the root section D-D is greater than the "arc" at the tip section A-A.

Figure 8:
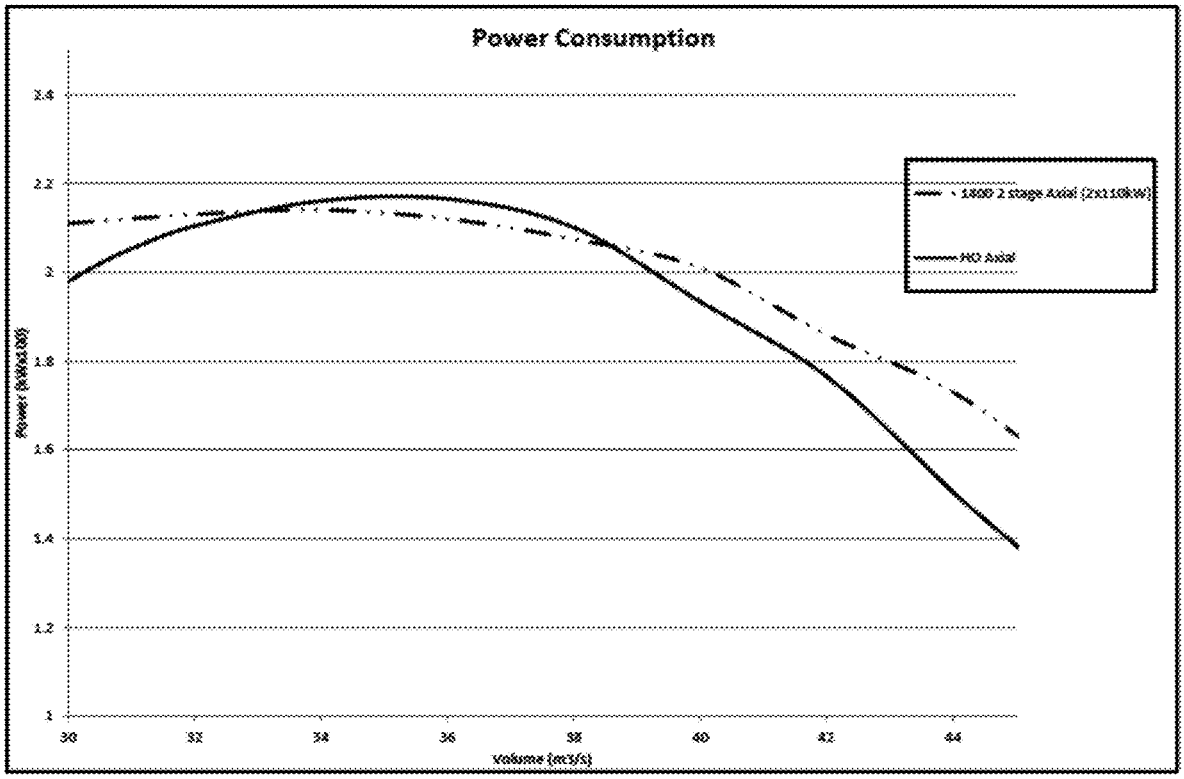
FIG. 8 is an example of a power/volume curve comparison the fan arrangement with a comparable duty two-stage axial fan.
Figure 9:
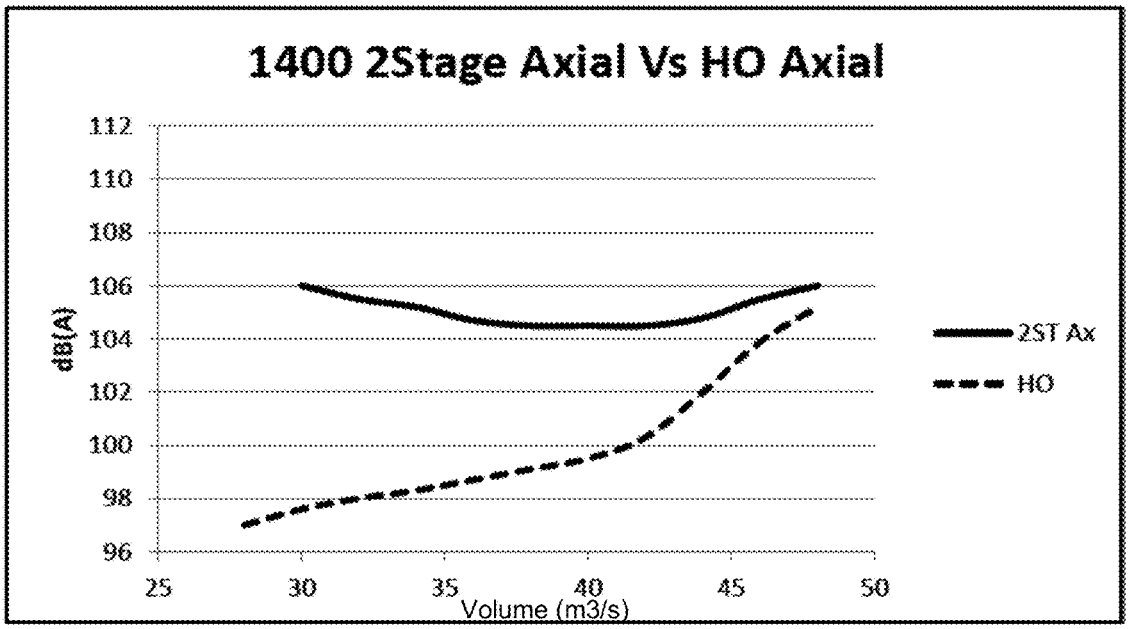
FIG. 9 is an example of a noise/volume curve comparison of the fan arrangement with a comparable duty two-stage axial fan.

It is also noted that the chord length of the blades 23 is much longer than what is typically used by an impulse bladed impeller and this results in a lower power consumption over the useful range of the impeller 22, as shown in FIG. 8. Moreover, the longer chord length provides a similar press-volume (PV) curve in comparison to an example axial fan that may be a two-stage axial fan suitable for a duct having a diameter of up to about 1400 mm. Accordingly, the fan arrangement 10 herein is particularly suitable to the duct ventilation market. Noise is also reduced as shown in FIG. 9 in comparison to a two-stage axial fan. It is noted that the fan arrangement 10 is capable of pushing about 40 $m^3/s$ at over 5.7 kPa. A traditional two-stage axial fan of similar diameter will stall at least than 5 kPa and is only capable of about 40 $m^3/s$ up to about 3.9 kPa.

Advantageously, there has been provided a fan arrangement having an impeller is that has an increased chord length, increased number of blades, a relatively high angle of attack of the blades and the flow compression arising from the tapered hub of the impeller. This provides an advantageous fan arrangement having a similar pressure characteristic over a useful range of the fan. The press-volume (PV) curve is also advantageous and suited the vent duct ventilation market.

Moreover, the fan performance arrangement characteristics mimics the functions of a two-stage axial fan but within a smaller installation envelope thus making the fan lighter and smaller than the comparable axial fans in the market and making installation easier and quicker. The need for less fan installations is also an advantage and results in less installation work whilst using existing cabling. The low end of the pressure volume curve rises higher than the comparable axial fans in the marketplace thus reducing the need for an additional fan, as the duct lengths get longer. The new impeller is smaller in size and features noise reduction characteristics thus noise generation is considerably less that the equivalent single axial fan installation for a given duty.

The impeller blades may be made of plate, rather than aerofoil shaped, thus are not affected by wear. The impeller blade design improvements changes its characteristics from a normally high volume PV (pressure-volume) curve to a steeper lower volume steeper PV curve but with a lower power consumption curve over a wide range of volume flow. The pressure range is substantially higher at the lower end than the comparable fans in the market thus delaying the need for the installation of an additional fan. Fundamentally, the fan arrangement provides a smaller, lighter, quieter, more industrious fan for the same ventilation and pressure range with less resistance meaning less relocations, repairs, safety exposure.

The features that may contribute to overcoming the existing problems are as listed below:

- Higher pressures for comparable flows: the combination of blade design features and efficient turning vane design leads to a better pressure rise characteristic than comparable axial fans available in the market;
- Weight: as the impeller is smaller in size for a given duty, the weight of the impeller will be less than the comparable axial fan on the market at present
- Noise: as the impeller is smaller, the blade tip speeds are smaller and thus the generated noise is less;
- Installation costs: as only one fan needs to be installed compared to two standard axial fans for a given duty, the installation time is halved;
- Maintenance savings: As the impeller is more robust and less dependent on blade shape for impeller performance, the maintenance requirement intervals are likely to be longer;
- OH&S concerns: as wear on the standard axial decreases performance dramatically, the likelihood of impeller failure increases due to stall for a given duct length. The risk of injury due to impeller failure is also increased. The delivered air to the end of the duct will decrease to a point that will be insufficient for the work being performed. As generated noise is less, the exposure to high noise sources will be smaller;
- Lower power characteristics: the new impulse bladed fan takes advantage of the available motor power compared to the standard axial fan to deliver more pressure at the lower volume end of the curve and slightly higher volumes at lower pressure requirements. The risk of motor overload is reduced without the need for other control systems.

Finally, it is noted that with this new impeller design makes the fan smaller than existing fans for the same duty and may be lighter in weight by up to 25%. The improved performance may delay the need for additional fans for longer ducts lengths. These features may also simplify installation and improve the OH&S as well as being able to use existing wiring. The power characteristic is largely lower for the practical range of duties that the fan is designed for, thus overloading of the fan motor is alleviated.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any known matter or any prior publication is not, and should not be taken to be, an acknowledgment or admission or suggestion that the known matter or prior art publication forms part of the common general knowledge in the field to which this specification relates.

While specific examples of the invention have been described, it will be understood that the invention extends to alternative combinations of the features disclosed or evident from the disclosure provided herein.

Many and various modifications will be apparent to those skilled in the art without departing from the scope of the invention disclosed or evident from the disclosure provided herein.

What is claimed is:

1. A fan arrangement for a duct, the fan arrangement including a housing having an inlet and an outlet adapted to communicate air with the duct and an axially rotatably driven impeller supported within the housing between the inlet and the outlet, the impeller including a hub carrying a plurality of blades that span in a radial direction outwardly of the hub, the plurality of blades being shaped to urge air between the inlet and the outlet, wherein the plurality of blades have a tip solidity ratio in the range of about 0.8 to 1.55, and wherein each of the plurality of blades has a twist angle between a root and a tip thereof in the range of about 15 to 30 degrees and a substantially constant thickness across a chord thereof, and wherein, when viewed in front plan form, leading edges and trailing edges of adjacent ones of the plurality of blades are parallel in a radial direction.

2. The fan arrangement according to claim 1, wherein the each of the plurality of blades has a substantially constant thickness along a length thereof between the root and the tip.

3. The fan arrangement according to claim 1, wherein a leading edge and a trailing edge of each of the plurality of blades are rounded.

4. The fan arrangement according to claim 1, wherein each of the plurality of the blades are formed from a metal plate twisted to provide the twist angle.

5. The fan arrangement according to claim 1, wherein the hub tapers outwardly in a direction between the inlet and outlet.

6. The fan arrangement according to claim 1, wherein the housing includes an inner housing supporting the impeller and an outer housing, the inner and outer housing defining a passageway therebetween through which air flows.

7. The fan arrangement according to claim 6, wherein a post-fan section of the passageway has a cross sectional area that is relatively smaller in comparison to a cross sectional area of a pre-fan section of the passageway.

8. The fan arrangement according to claim 7, wherein the hub is shaped to provide a tapered transition between the pre-fan and post-fan sections of the passageway.

9. The fan arrangement according to claim 8, wherein the inner housing includes a nose section, a trailing section with the hub located between the nose section and trailing section, wherein a diameter of the trailing section is greater than a diameter of the nose section.

10. The fan arrangement according to claim 9, wherein the inner housing includes a tail cone extending from and tapering inwardly from the trailing section.

11. The fan arrangement according to claim 9, wherein a leading tip of the nose section is shaped to be streamlined.

12. The fan arrangement according to claim 9, wherein the trailing section includes a flow straightener.

13. The fan arrangement according to claim 12, wherein the flow straightener is provided in the form a plurality of turning vanes arranged to provide a substantially axial flow.

14. The fan arrangement according to claim 9, wherein the nose section includes a flow conditioner shaped to guide air to the blades.

15. The fan arrangement according to claim 14, wherein the flow conditioner is provided in the form of at least one of static and adjustable pre-rotator blades.

16. The fan arrangement according to claim 15, wherein the outer housing includes an inlet cone arranged prior to the flow conditioner to direct air flow into the passageway and an outlet evasee after the flow straightener, the inlet cone and outlet evasee coupling to the duct.

17. The fan arrangement according to claim 6, wherein the inner and outer housings are each generally cylindrical in shape and concentrically arranged about an axis of rotation of the hub.

18. The fan arrangement according to claim 6, wherein the inner housing contains a motor arranged to drive the hub.

19. The fan arrangement according to claim 1, wherein each of the plurality of blades includes a chord toward the tip that is relatively longer than the chord toward the root.

20. The fan arrangement according to claim 1, wherein an angle of attack at the root of each of the plurality of blades is less than an angle of attack at the tip of each of the plurality of blades.

21. A blade for a fan arrangement as defined in claim 1.

22. An impeller for a fan arrangement as defined in claim 1.

23. A ventilation system including one or more fan arrangements as defined in claim 1 fitted to a duct to drive air between an inlet and outlet of the duct.

24. A method of conveying air using a fan arrangement as defined in claim 1 including fitting the fan arrangement with a duct and operating the fan arrangement to drive air between an inlet and outlet of the duct.

25. The fan arrangement according to claim 1, wherein the tip solidity ratio in the range of about 0.8 to 1.2.

26. The fan arrangement according to claim 1, wherein the tip solidity ratio in the range of about 1.25 to 1.55.

27. A fan arrangement for a duct, the fan arrangement including a housing having an inlet and an outlet adapted to communicate air with the duct and an axially rotatably driven impeller supported within the housing between the inlet and the outlet, the impeller including a hub carrying a plurality of blades that span in a radial direction outwardly of the hub, the plurality of blades being shaped to urge air between the inlet and the outlet, wherein the plurality of blades have a tip solidity ratio in the range of about 0.8 to 1.55, and wherein each of the plurality of blades has a substantially constant thickness across a chord thereof and a chord length toward the tip is relatively longer than a chord length toward the root, and wherein, when viewed in front plan form, leading edges and trailing edges of adjacent ones of the plurality of blades are parallel in a radial direction.

28. A fan arrangement for a duct, the fan arrangement including a housing having an inlet and an outlet adapted to communicate air with the duct and an axially rotatably driven impeller supported within the housing between the inlet and the outlet, the impeller including a hub carrying a plurality of blades that span in a radial direction outwardly of the hub, the plurality of blades being shaped to urge air between the inlet and the outlet, wherein the plurality of blades have a tip solidity ratio in the range of about 0.8 to 1.55, wherein each of the plurality of blades has-a twist angle between a root and a tip thereof in the range of about 15 to 30 degrees, and a length of the chord toward the tip that is relatively longer than the chord toward the root, wherein, when viewed in front plan form, leading edges and trailing edges of adjacent ones of the plurality of blades are parallel in a radial direction.

29. An impeller for a ducted fan arrangement having an inlet and an outlet, the impeller including a hub carrying a plurality of blades that span in a radial direction outwardly of the hub, the plurality of blades being shaped to urge air between the inlet and the outlet, wherein the plurality of blades have a tip solidity ratio in the range of about 0.8 to 1.55, wherein each of the plurality of blades has a twist angle between a root and a tip thereof in the range of about 15 to 30 degrees and a substantially constant thickness across a chord thereof, and wherein, when viewed in front plan form, leading edges and trailing edges of adjacent ones of the plurality of blades are parallel in a radial direction.

30. The impeller according to claim 29, wherein the hub is shaped so as to compress flow as it passes through the plurality of blades.

31. The impeller according to claim 30, wherein the hub is tapered.

32. The impeller according to claim 29, wherein the each of the plurality of the blades are formed from a metal plate twisted to provide the twist angle.

33. The impeller according to claim 29, wherein each of the plurality of blades includes a chord toward the tip that is relatively longer than the chord toward the root.

34. The impeller according to claim 29, wherein an angle of attack at the root of each of the plurality of blades is less than an angle of attack at the tip of each of the plurality of blades.

35. The impeller according to claim 29, wherein at least one of leading and trailing edges of each of the plurality of blades are rounded.

36. A method of forming a fan arrangement for a duct, the method including the steps of:

forming a housing having an outer housing and an inner housing so as to form a passageway therebetween, the inner housing supporting a rotatable axially arranged impeller and the housing being shaped such that a pre-impeller section of the passageway is relatively larger in cross section to a post impeller section of the passageway;

forming the impeller so as to have a tapered hub between the pre and post impeller sections with the tapered hub carrying a plurality of blades that substantially span in a radial direction between the hub and an internal surface of the outer housing, the plurality of blades being shaped to urge air between an inlet and an outlet of the housing and, forming the plurality of blades so as to have a tip solidity ratio in the range of about 0.8 to 1.55, and so that each of the plurality of blades has a twist angle between a root and a tip thereof in the range of about 15 to 30 degrees and a substantially constant thickness across a chord thereof, and that when viewed in front plan form, leading edges and trailing edges of adjacent ones of the plurality of blades are parallel in a radial direction.

37. A method of forming an impeller for a ducted fan arrangement having an inlet and an outlet, the method including:

forming a hub arranged to taper outwardly in a direction between the inlet and outlet;

forming a plurality of blades to fit with the hub from a material having a substantially constant thickness across a chord thereof and having a twist angle between a root and a tip thereof in the range of about 15 to 30 degrees;

forming the impellor by coupling the plurality of blades to the hub such that the plurality of blades span in a radial direction outwardly of the hub to urge air between the inlet and the outlet and have a tip solidity ratio in the range of about 0.8 to 1.55, and that when viewed in front plan form, leading edges and trailing edges of adjacent ones of the plurality of blades are parallel in a radial direction.

38. A fan arrangement for a duct, the fan arrangement including a housing having an inlet and an outlet adapted to communicate air with the duct and an axially rotatably driven impeller supported within the housing between the inlet and the outlet, the impeller including a hub carrying a plurality of blades that span in a radial direction outwardly of the hub, the plurality of blades being shaped to urge air between the inlet and the outlet, wherein the plurality of blades have a tip solidity ratio in the range of about 0.8 to 1.55, and wherein each of the plurality of blades has a twist angle between a root and a tip thereof in the range of about 15 to 30 degrees and a substantially constant thickness thereby being non-aerofoil shaped, and wherein, when viewed in front plan form, leading edges and trailing edges of adjacent ones of the plurality of blades are parallel in a radial direction.

* * * * *